United States Patent [19]

Schutt et al.

[11] Patent Number: 4,529,365

[45] Date of Patent: Jul. 16, 1985

[54] COMPRESSOR WITH LONGITUDINALLY EXTENDING COOLING FINS

[75] Inventors: Peter Schutt, Lochgau; Klaus Nitsche, Erligheim; Horst Grindler, Freudental; Hans-Joachim Hofmann, Remshalden, all of Fed. Rep. of Germany

[73] Assignee: Durr-Dental GmbH & Co., KG, Bietigheim, Fed. Rep. of Germany

[21] Appl. No.: 555,436

[22] Filed: Nov. 25, 1983

Related U.S. Application Data

[63] Continuation of Ser. No. 297,360, Aug. 28, 1981, abandoned.

[30] Foreign Application Priority Data

Aug. 29, 1980 [DE] Fed. Rep. of Germany ..... 3032518

[51] Int. Cl.[3] ..... F04B 39/06; F04B 39/16

[52] U.S. Cl. ..... 417/313; 417/368; 417/415; 92/144

[58] Field of Search ..... 417/313, 368, 415, 560, 417/571; 92/144, 155, 171

[56] References Cited

U.S. PATENT DOCUMENTS

| | | | |
|---|---|---|---|
| 2,134,077 | 10/1938 | Ehret | 417/313 |
| 2,605,044 | 7/1952 | Hill | 417/415 |
| 2,899,130 | 8/1959 | Sykes | 417/234 X |
| 3,145,914 | 8/1964 | Nicholas | 417/415 |
| 3,375,972 | 4/1968 | Raufeisen | 417/571 |
| 3,521,607 | 7/1970 | Wiseman et al. | 92/171 X |
| 4,190,402 | 2/1980 | Meece et al. | 417/415 |
| 4,350,475 | 9/1982 | Meece et al. | 417/368 |

FOREIGN PATENT DOCUMENTS

| | | | |
|---|---|---|---|
| 1255390 | 11/1967 | Fed. Rep. of Germany | 92/171 |
| 3046434 | 7/1982 | Fed. Rep. of Germany | 92/144 |
| 160575 | 3/1921 | United Kingdom | 92/171 |
| 216157 | 11/1924 | United Kingdom | 92/144 |
| 456502 | 11/1936 | United Kingdom | 417/243 |

*Primary Examiner*—William L. Freeh
*Assistant Examiner*—Paul F. Neils
*Attorney, Agent, or Firm*—Robert E. Burns; Emmanuel J. Lobato; Bruce L. Adams

[57] ABSTRACT

An oil-less gas compressor comprises at least one cylinder block mounted on a crankcase, the outer end of the cylinder block being closed by a cylinder head. A piston in the cylinder block bore is reciprocated by a motor-driven crankshaft in the crankcase. The cylinder blocks and cylinder heads are generally square in cross section. On all four sides of the cylinder block and cylinder head there are spaced cooling fins which extend in an axial direction. Axially extending cooling air passages between the fins communicated at their lower ends with the interior of the crankcase. Air drawn into the crankcase by a fan on the crank shaft flows into and through these cooling air passages to cool the cylinder block and head. In one corner portion of the cylinder block and head there is an integral axially extending suction bore containing a filter. In an adjacent corner portion of the cylinder block there is an axially extending compressed air bore. In the other two corner portions there are tubular air passages which likewise communicate with the interior of the crankcase.

17 Claims, 8 Drawing Figures

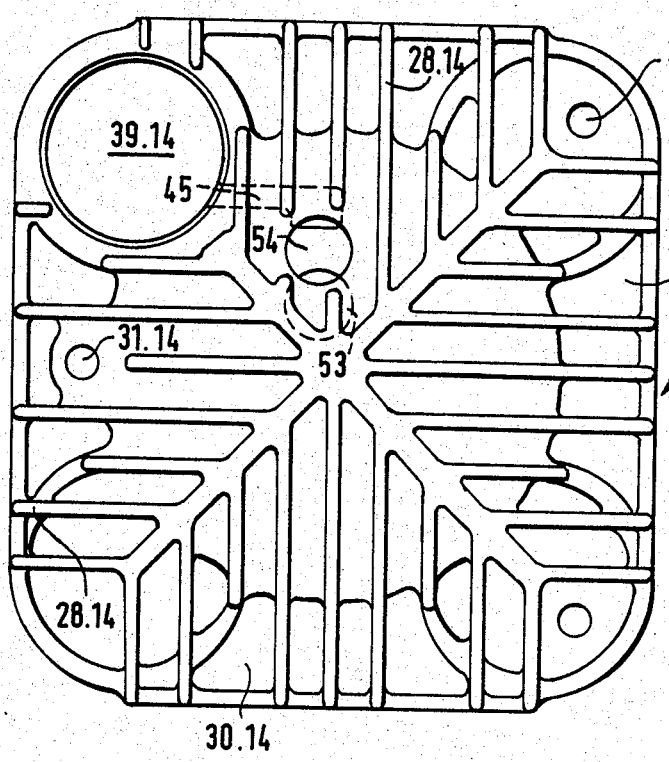
Fig. 8
Fig. 6
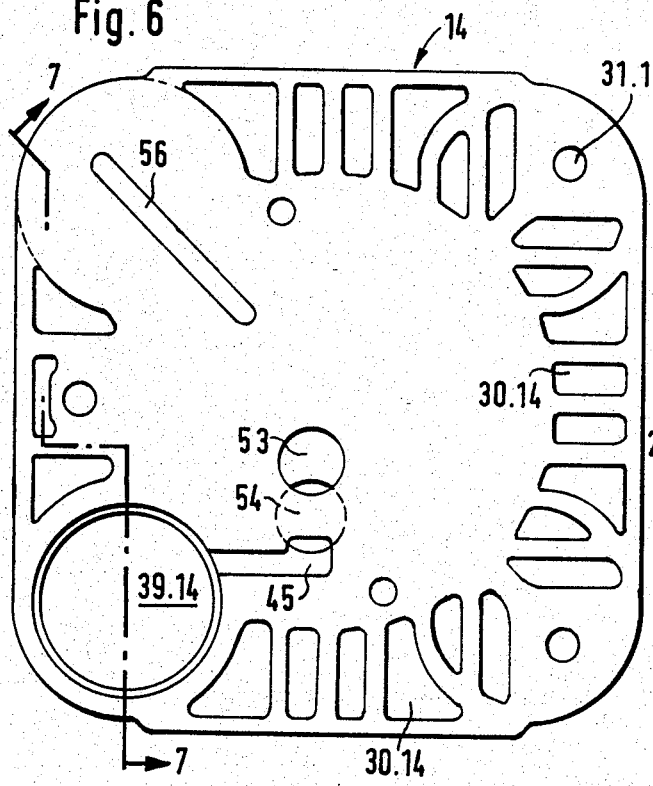
Fig. 7
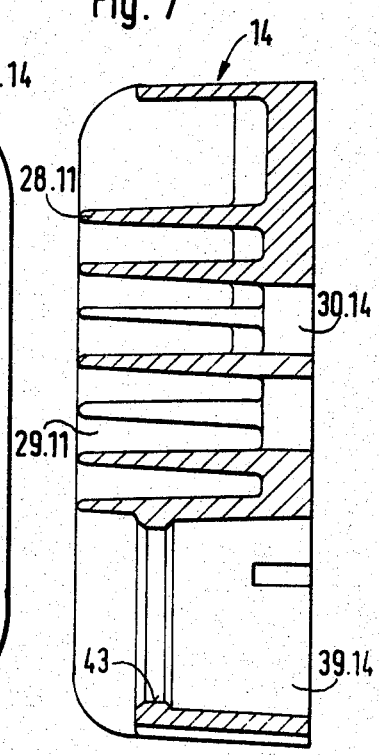

COMPRESSOR WITH LONGITUDINALLY EXTENDING COOLING FINS

This application is a continuation of Ser. No. 06/297,360 filed 8-28-81 and now abandoned.

FIELD OF INVENTION

The present invention relates to an oil free compressor having a crankcase and at least one cylinder block mounted on the crankcase and closed at its outer end by a cylinder head. A piston in the cylinder of the cylinder block is reciprocable by a motor driven crankshaft in the crankcase. An inlet and outlet are connected with the cylinder through valves so that air is drawn in through the inlet, compressed in the cylinder by the piston and discharged through the outlet. While, for convenience, the invention will be described as an air compressor, it will be understood that it may be used for other gasses. Moreover, it may be used as a suction pump by connecting the inlet to the vessel or space to be exhausted.

BACKGROUND OF THE INVENTION

Oil free compressors are used to compress gasses, in particularly air, for example for the medical technique, for pneumatic control or for the food industry. Medical use comprises, for example, driving drills for dental work, for water and air cleaning or for apparatus for artificial respiration. In the food industry oil free compressed air is used, for example, as drying air for packing machines or for bread dough fermentation. General technical use comprises, for example, for letter sorting apparatus, for the aeration of galvanic and chemical bathes and aquariums, for the pneumatic control of machine tools and other machines, for film coating or for ventilation of computers.

SUMMARY OF THE INVENTION

It is an object of the present invention to provide a compressor which is compact and of simple construction, can deliver a large amount of compressed air, is quiet in operation and is efficiently cooled so that it does not overheat even in continuous high-duty operation.

In accordance with the invention there is provided an oil free compressor in which passages for the useful air and cooling air run in a direction axial of the cylinder block. Such arrangement of these air passages permits a very simple production of the individual parts of the compressor. Moreover, it makes possible effective cooling of the compressor which leads to a higher air delivery and a longer useful life. The arrangement of the useful air passages in the direction of the cylinder block axis enables conducting the useful air in a manner that leads to quiet operation of the compressor.

Oil free compressors are known in which a piston is reciprocable in a cylinder projecting from a crankcase. With such arrangement the cooling surface of the cylinder is limited and no good conduction of the cooling air around the entire cylinder is possible. With an oil free compressor in accordance with the present invention, on the contrary, the cylinder block is mounted on the crankcase and has cooling passages which extend axially of the cylinder block and are connected with the crankcase. The crankcase has cooling air inlet openings through which cooling air flows. In places where the cylinder block must be stable, for example in places through which fastening screws extend to secure the cylinder block to the crankcase, the cylinder block is provided with openings. In mechanically less loaded places, the cylinder block is provided with cooling fins between which there are spaces through which cooling air from the crankcase flows. In this manner excellent cooling of the pressure air is attained and this leads to a high delivery. An especially compact construction of the cooling system is obtained when a motor driven fan is provided in the crankcase.

Compressors are known in which air is drawn in through a filter integrated in the compressor housing. However, the space filled with porous material for filtering the air is not directly adjacent the compression bore. In a compressor according to the invention, the inlet for the air that is to be compressed comprises a dead end bore formed in the cylinder block containing a filter and connected with the compression bore through a recess in the cylinder head and a valve. The cool air that is to be compressed is drawn in through the inlet bore whereby the cylinder block is additionally cooled.

An especially simple form of the cylinder block and cylinder head with an inlet bore in the cylinder block is attained when there is arranged between the cylinder head and the cylinder block a reed valve plate of which an inlet reed valve presses against the opening of a dead ended valve bore in the cylinder head and the inlet bore is connected with a slot formed in the lower face of the cylinder head which in turn is connected with the valve bore by a dead ended bore which extends down from the top of the cylinder head and is closed by a cap. In this manner the cylinder head can be formed as a simple casting that requires no further work but only the insertion of the closure cap which is commercially available.

As previously mentioned, it is known to provide in the compressor housing an inlet bore filled with porous material for filtering the air. A particular advantage of a compressor in accordance with the invention is that a filter can be inserted in the inlet bore through an opening in the cylinder head. This permits quick and easy changing of the filter which is not possible with a filter bore filled with porous filter material. This assures that with a compressor in accordance with the invention the compressed air is always clean.

Especially quiet operation of the compressor on the inlet side is achieved when the filter is a paper filter with an outer support which is received in an opening in the cylinder head and is sealed by a restriction in the inlet opening.

It is known in reciprocating piston compressors of small refrigeration machines to weld or cast a pressure chamber of large volume on the compressor part that contains the compression cylinder. In this pressure chamber pulses generated in the compression cylinder are smooth out. Such quieting of the pressure gas is also desirable in an oil free compressor as this leads to quieter running of the compressor. The larger the volume of the pressure chamber the quieter the compressor runs. With a compressor in accordance with the invention, such enlargement of a pressure chamber is possible in a simple manner in that a compressed air chamber formed in a wall of the crankcase housing with its longitudinal axis parallel to the axis of rotation of the crankshaft has a connecting bore through which the compressed air is received and is in constant communication with the pressure bore in the cylinder block through an air channel which runs partly as a housing air channel in the crankcase wall and partly as a block air channel in the cylinder block. The enlargement of the pressure volume through connection of the pressure chamber in the crankcase wall to the pressure bore in the cylinder block leads to a large starting volume in that the initial back pressure is almost atmospheric whereby it is possible to use an electric motor which is too weak to start against the ultimate pressure. With a compressor in accordance with the invention it is also possible, instead of enlarging the compressed air bore through a connection with the air chamber in the crankcase housing, to enlarge the suction bore through connection with the chamber in the crankcase housing.

With a compressor in accordance with the invention not only is a simple enlargement of the volume of the pressure air bore possible but thanks to the bore being in the direction of the cylinder block longitudinal axis, it is easy to produce a compressor in accordance with the invention with a pressure air bore. Thereto it is provided that the pressure air bore is connected with the compressor cylinder bore through a pressure air slot in the cylinder head closed by a pressure air reed valve. Compressors are known which can selectively be operated with one or more cylinders. However, in operating with more than one cylinder, connecting lines are required at least on the pressure side. An oil free compressor in accordance with the present invention on the other hand can operate as desired with one or with two cylinders. For a two cylinder compressor, two identical cylinder blocks with identical cylinder heads are mounted on a crankcase. Both are connected with a compressed air chamber in a housing wall through housing air channels. Thereby it is unnecessary to provide special connecting lines. If only one cylinder is used, one side of the crankcase and one housing air channel are closed.

Production techniques yield an especially simple construction when the crankcase has two supporting faces at an angle to one another to receive like cylinder blocks and when the compressed air chamber is provided in a corner of the crankcase between the two support faces. The compressed air chamber can then be produced directly by casting and the open end of the chamber can be closed after production with a screwed-in closure.

Oil free compressors are known which have a compressed air bore in the compressor housing common to two cylinders. However, the compressed air bore belonging to different parts of the crankcase housing has a large face to be closed. This presents serious difficulties in production and requires a closure with many fastening means. With a compressor in accordance with the present invention, on the contrary, hardly any machining of the individual cast parts is required. To provide a seal between the reed valve plate and the cylinder bore and compressed air bore as well as between the housing air canal and the cylinder block air canal, O-rings are arranged in grooves. To provide a connection between the cylinder head cylinder block and crankcase, it is sufficient to use three screws which pass through screw bores at approximately equal angles around the cylinder block longitudinal axis and are screwed into tapped holes in the support face of the crankcase.

BRIEF DESCRIPTION OF DRAWINGS

The invention and its advantages will be more fully

FIG. 6 is a bottom view of one cylinder head;

FIG. 7 is a section taken approximately on the line 7—7 in FIG. 6; and

FIG. 8 is a top plan view of a cylinder head as shown in FIG. 6.

DESCRIPTION OF PREFERRED EMBODIMENT

Figure 1:
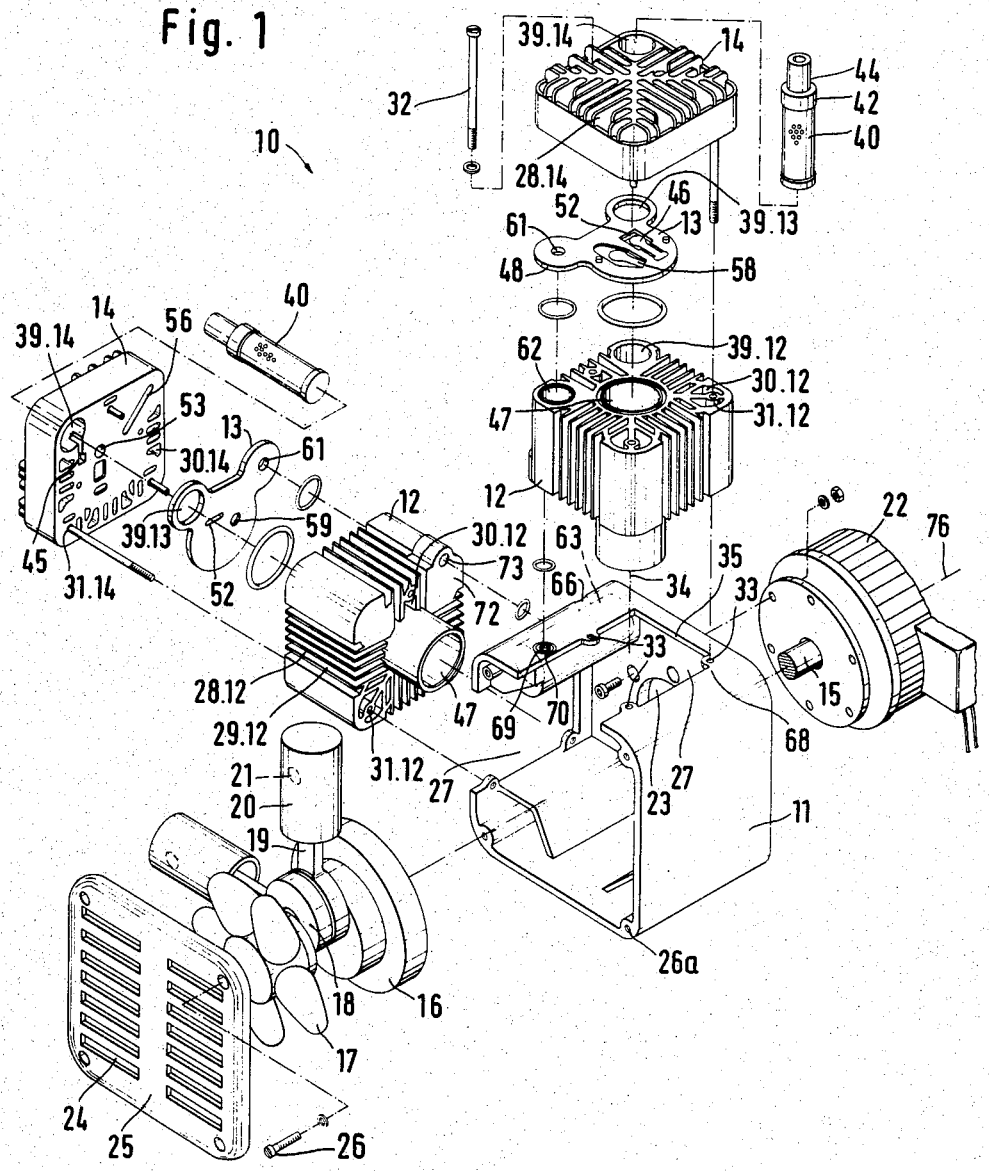
FIG. 1 is an exploded schematic perspective view of an oil free compressor in accordance with the invention comprising a crankcase in which a crankshaft driven by an electric motor is connected by two connecting rods with pistons reciprocable in two identical cylinder blocks closed by cylinder heads with reed valve plates between the cylinder blocks and the cylinder heads.

In FIG. 1 there is shown an oil free compressor 10 with a crankcase 11, two cylinder blocks 12, two reed valve plates 13 and two cylinder heads 14. The crankcase 11 is made as an approximately quadratic aluminum casting. Inside the crankcase a fly wheel disc 16 and fan 17 driven by a motor shaft 15 rotate around an axis of rotation 76. Two connecting rods 19 are rotatably connected with a connecting rod bearing 18 provided on the fly wheel disc 16 eccentric to the motor shaft 15. At its outer end each of the connecting rods 19 is connected with a compressing member formed as a cylinder 20 with a wrist pin 21. The electric motor 22 is flange mounted in normal manner on the back face of the crankcase 11. However, in FIG. 1 the electric motor 22 with the motor shaft 15, fly wheel disc 16 and fan 17 are shown outside the crankcase for clarity of illustration.

The right and lower sides of the approximately quadratic crankcase 11 are closed. The back side of the crankcase has a motor shaft opening 23 which, however is closed by the flange mounted motor 22. The front side of the crank case is closed by a cover 25 having a plurality of cooling air inlet openings 24. The cover 25 is removably secured on the front side of the crankcase 11 by four screws 26 screwed into screw holes **26*a* in the crankcase. The two remaining sides of the crankcase, i.e. the upper and left sides, have openings 27 for pistons 20 and the lower parts of the bushings 77 of cylinder blocks 12. Also through the openings 27, air drawn by the fan 17 through the cooling air inlet openings 24 of the housing cover 25** is blown.

The cylinder block 12 has cooling air passages comprising spaces 29.12 between cooling fins 28.12 and cooling air openings 30.12. It will be seen that the cooling fins 28.12 and cooling openings 30.12 extend axially the full length of the cylinder block. The cooling ribs 28.12 and the spaces 29.12 between them are provided on parts of the cylinder block that are subjected to little mechanical stress. The cooling air openings 30.12 comprise longitudinally extending bores through which extend bolts 32 which are screwed into tapped holes 33 section. There are three screw bores 31 of which two are in adjacent corners of the square while the third is in the middle of the side which lies opposite the common edge of the two corner screw bores. This three point fastening assures simple production of the fastening means and a secure and quick fastening of the cylinder blocks on the crankcase 11. This simple manner of fastening is made possible through the overall simple construction of the compressor as will appear further below.

Figure 4:
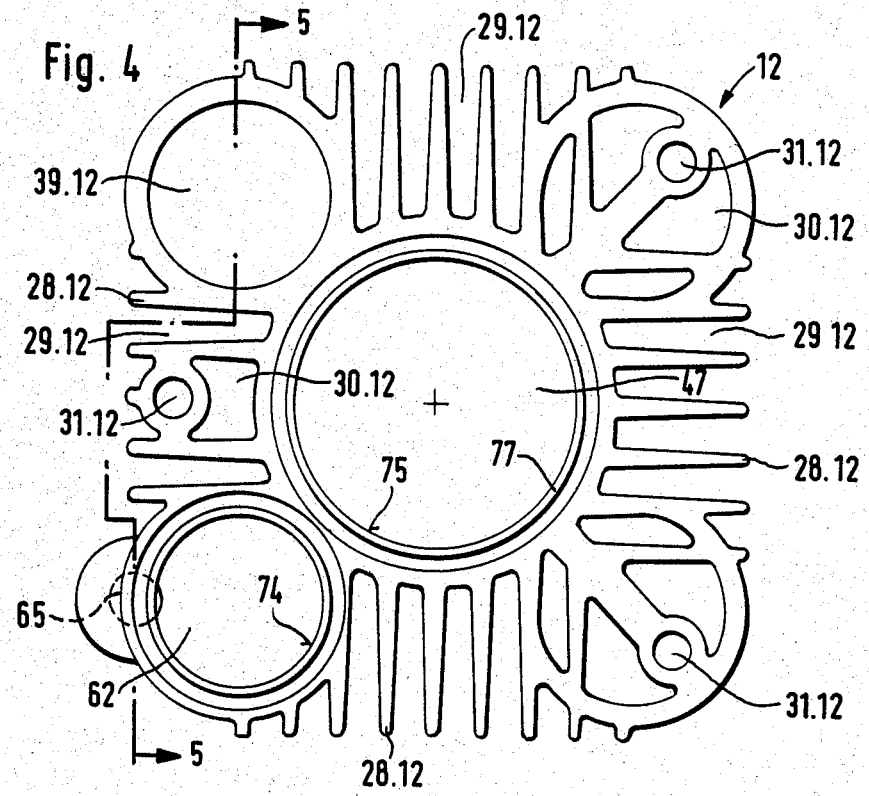
FIG. 4 is a top plan view of one cylinder block.
Figure 5:
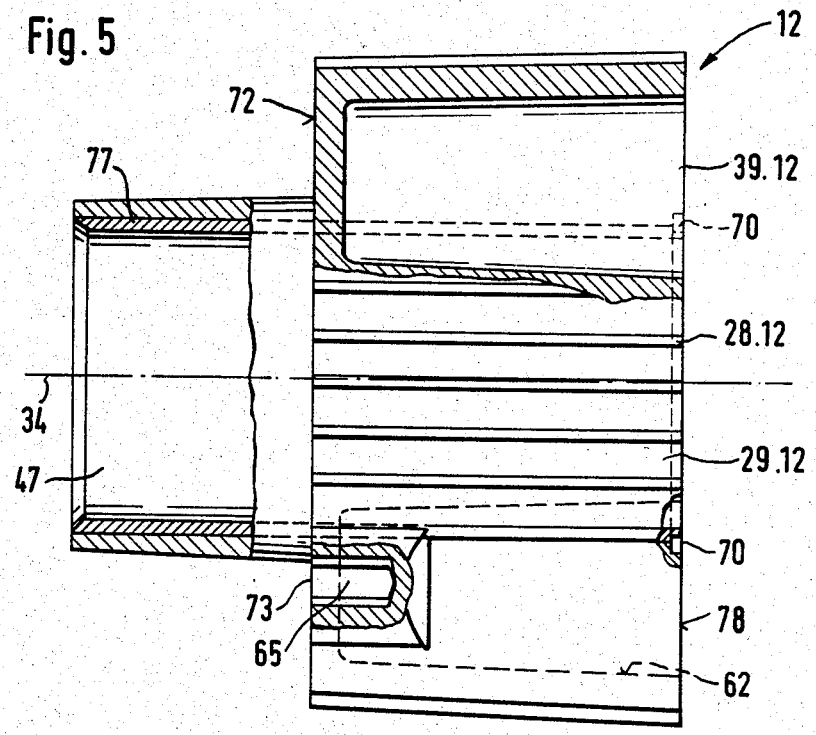
FIG. 5 is a side view partially in section of one cylinder block.

The pattern of the cooling ribs 28.12, passages 29.12 between the ribs and cooling air openings 30.12 and bolt bores 31.12 is seen from the top plan view of a cylinder block 12 shown in FIG. 4. In a plan view of one cylinder shown in FIG. 2, the edge 35 of the piston opening 27 in the crankcase 11 is shown partially in dotted lines while the cooling fins 28.12, the cooling air passages 29.12 between the fins and the cooling air openings are shown in dot-dash lines. From this it will be seen that the piston openings 27 of the crankcase are sufficiently large that the cooling air drawn into the crankcase by the fan 17 passes out through the cooling air passages 29.12 and the cooling air openings 30.

Figure 3:
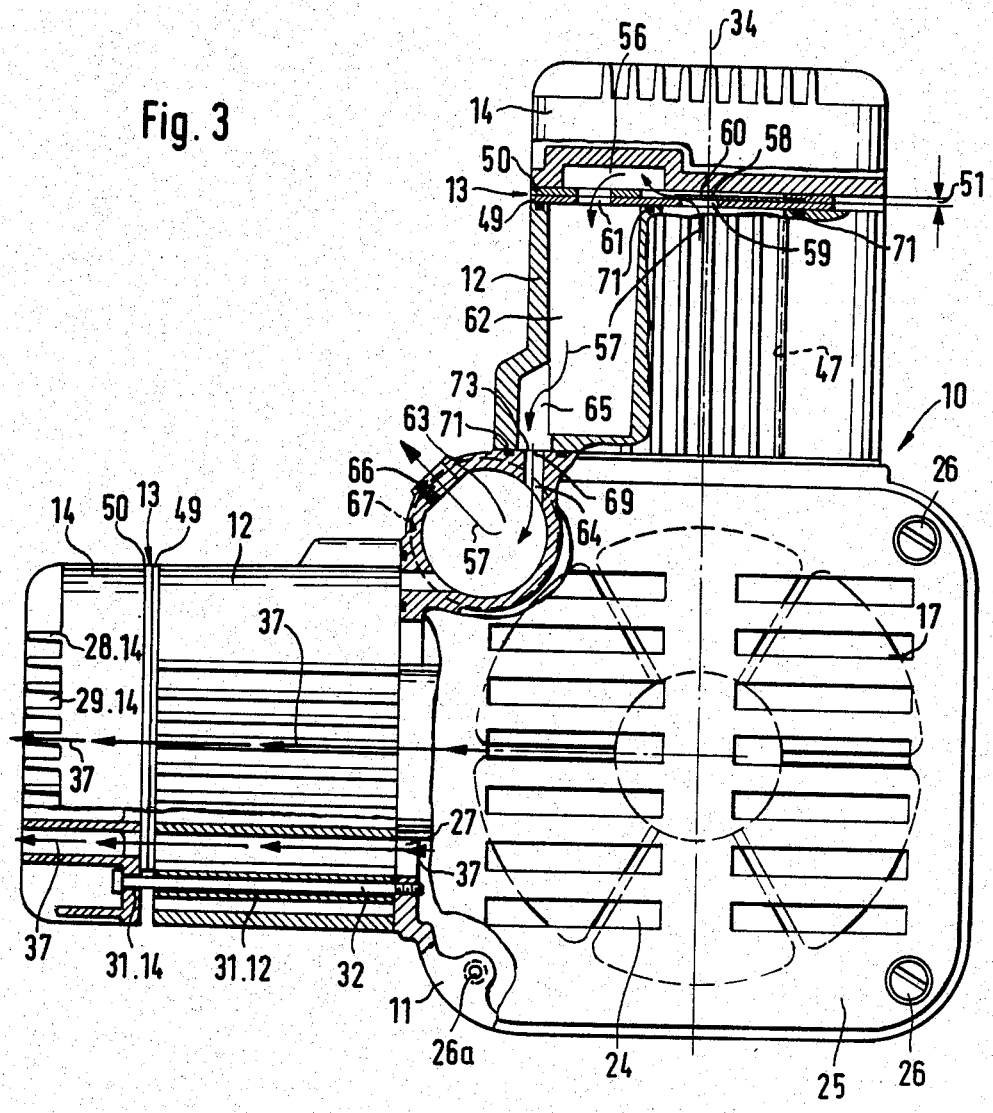
FIG. 3 is a schematic end view of the crankcase and two cylinders with parts broken away and shown in section.

As seen from FIGS. 1 and 6–8, the cylinder head 14 is also provided with cooling fins 28.14, cooling air passages 29.14 between the fins and cooling air openings 30.14. Thus as illustrated in FIG. 3, the cooling air 37 from the fan 17 is blown through the crankcase opening 27 in the crankcase 11 into the cooling air passages 29.12 and cooling air openings 30.12 in the cylinder block and then through the cooling air passages 29.14 between the fins and cooling air openings 30.14 in the cylinder head 14. In this manner excellent cooling of the entire compressor is achieved with a simple structure. The effective cooling leads to a high compressed air delivery and to a long useful life of the compressor.

Figure 2:
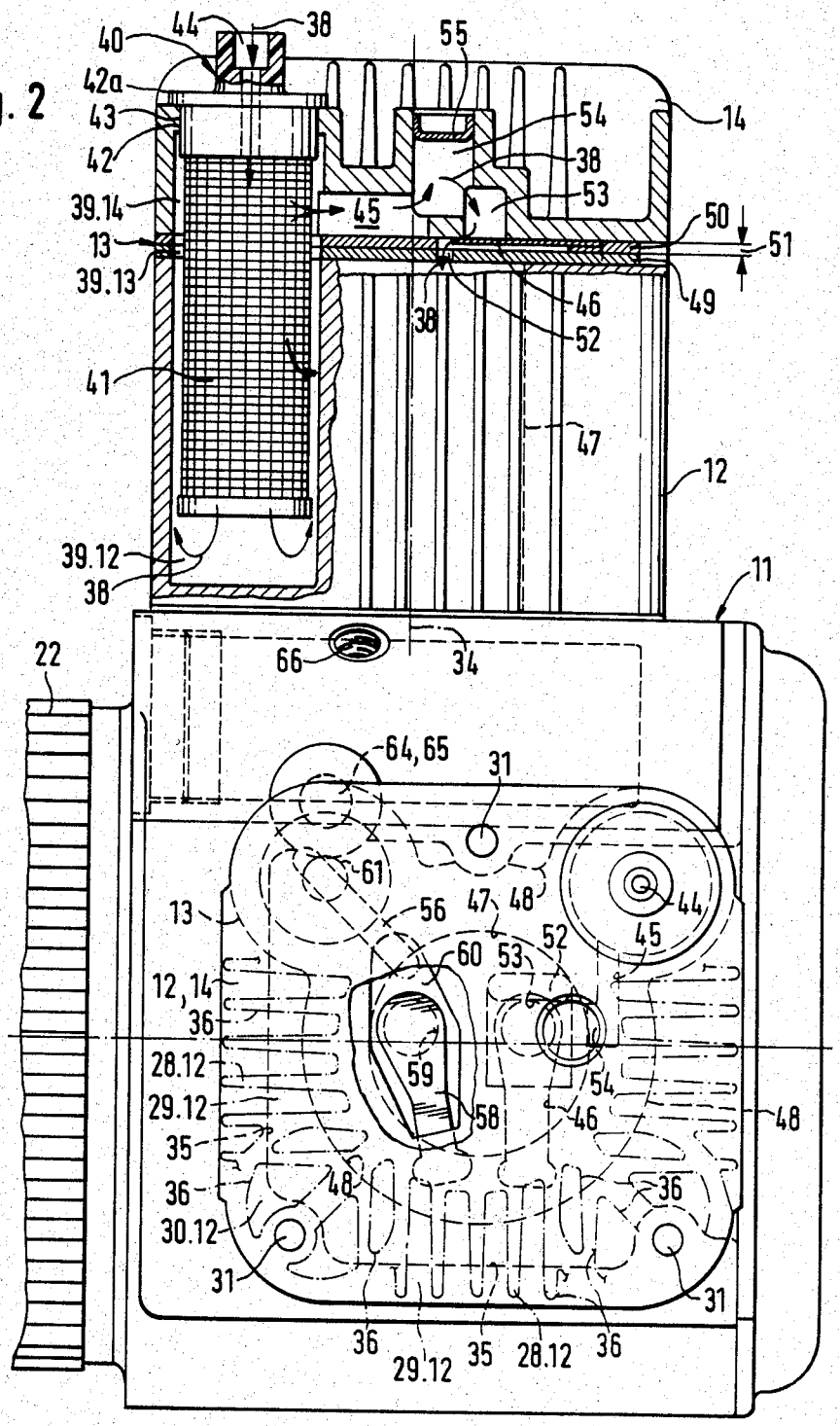
FIG. 2 is a schematic side elevation of the crankcase with two cylinders, passages for suction air, pressure air and cooling air, portions being broken away to show interior construction.

The path of the stream of air 38 that is to be compressed will be described with reference to FIGS. 1 and 2. In the cylinder block 12, the reed valve plate 13 and cylinder head 14 there is provided a suction bore 39 comprising a portion 39.12 in the cylinder block, a portion 39.13 in the reed valve plate and a portion 39.14 ih the cylinder head. This suction bore is closed at its lower end as seen in FIG. 2 and is open at is upper end to receive an air filter 40. The air filter comprises a cylindrical perforate support 41 in which there is a paper filter bag. At its upper end the filter is closed by a plug portion 42 which fits snugly in a sealing ring 43 of the suction bore 49.14 in the cylinder head to form a seal. A flange **42*a* seats on the upper end of the suction bore. The air filter 40 is of smaller diameter than the suction bore 39— except for the sealing ring 43— and extends down to within a short distance of the bottom of the blind bore. An advantage of such an air filter 40 integrated in the cylinder head 14 and cylinder block 12 is that there is no danger of the filter being damaged. Even with a strongly vibrating compressor, the air filter 40 is always safe in the suction bore 39**. Moreover, the filter can easily be changed at any time.

The suction bore 39 and hence the air filter 40 extend in the direction of the cylinder block axis 34. In the plug portion 42 at the upper end of the air filter 40 there is a suction opening 44. This has a restriction which is shown as step-form in FIG. 2 but which can also be formed conical. Through this restriction a reduction in intake noise of the compressor is achieved.

The air stream 38 drawn in through the suction opening 44 passes through the filter 40 and enters a suction slot 45 formed in the cylinder head 12. From the suction slot 45 the air stream 38 passes through a connecting bore 54 into a valve bore 53 and then through an inlet reed valve 46 into the cylinder bore 47. In the cylinder bore 47 the air is drawn down by the piston 20. The cylinder bore 47 is lined with a cylindrical cylinder bushing 77 formed, for example, of brass.

The inlet reed valve 46 is secured on the two-layer reed valve plate 13 which is clamped between the cylinder block and the cylinder head. The form of the reed valve plate 13 in a plane perpendicular to the cylinder block axis 34 is shown by the peripheral edge 48 of the reed valve plate in FIG. 2. The lower layer 49 of the reed valve plate is a steel plate while the upper layer 50 is formed of a packing material. The inlet reed valve 46 is secured on the upper face of the upper layer 50. Underneath the inlet valve 46 the packing material of the upper layer 50 is cut out so that the inlet reed valve 46 can move downwardly to the lower layer 49. The stroke of the inlet reed valve thus corresponds approximately to the thickness of the upper layer 50. In the lower layer 49 adjacent the inlet reed valve 46 there is a fresh air opening 52 which communicates with the compression cylinder bore 47.

The valve bore 53 is a blind bore formed in the cylinder head over the inlet reed valve 46. The term "over" in this description is understood to mean in a direction away from the crankcase while the term "below" means in a direction toward the crankcase. The valve bore 53 is connected with the suction slot 45 by the connecting bore 54 which is formed in the cylinder head from above. The upper end of the connecting bore 54 is closed by a closure cap 55 such as is commercially available. When the piston 20 moves downwardly in the cylinder bore 47, air is drawn through the suction opening 44, air filter 40, suction slot 45, connecting bore 54, valve bore 53, inlet reed valve 46 and fresh air opening 52 into the compression cylinder bore 47.

By reason of this construction the cylinder head 14 can be produced as a simple casting which requires no further working except for the insertion of the closure cap 55 in the connecting bore 54. All slots and bores in the cylinder head extend in a direction axial of the cylinder block whereby they can easily be formed in the casting. Also the walls of the pressure air slot 56, the function of which will be described, and all cooling air passages run in a direction axial of the cylinder block.

The path of the pressure air stream 57 will now be described with reference to FIG. 3. An outlet reed valve 58 secured on the upper face of the lower layer 49 of the reed valve plate 13 in position to close an outlet opening 59 in the layer 49. Above the outlet reed valve 58 the upper layer 50 of the reed valve plate is cut out so that the outlet reed valve 58 can move upwardly to the underside of the cylinder head 14. The stroke of the outlet reed valve 58 thus corresponds essentially to the thickness 51 of the upper layer 50. Recess 60 in the cylinder head 14 above the outlet reed valve 58 communicates with a pressure air slot 50 in the cylinder head. This slot 50 leads to a pressure air opening 61 in the reed valve plate 13 that opens into the upper end of a pressure air bore 62 formed in the cylinder block. The pressure air bore 62 is formed in one corner portion of the cylinder block as seen in FIG. 4 and extends axially of the cylinder block. Thus the pressure air stream 57 passes through the outlet opening 59 and open outlet reed valve 58 into the recess 60 and from there through the pressure air slot 56 in the cylinder head and pressure air opening 61 in the reed valve plate 13 into the pressure bore 62 in the cylinder block 12. From there the pressure air can be taken for use as desired.

The use of blind and large volume pressure air bore 62 has important advantages over compressors in which the pressure air is taken directly after passing through the outlet valve. The pressure air bore 62 works namely as a quieting air volume for smoothing out pulses in the air produced by reciprocation of the piston and thereby reduces exhaust noise. Moreover, the pressure air bore serves as a starting volume to facilitate starting of the motor which drives the compressor. Such starting volume is necessary when using a motor that does not have sufficient power to overcome high back pressure in the compressor when starting. With the construction in accordance with the invention, the air in the large volume pressure air bore is first compressed from approximately atmospheric pressure to the working pressure of the compressor. By reason of this the motor can easily start. When the working pressure is reached, a one way valve opens from the pressure air bore 62 into a compressed air tank.

The compressor construction so far described makes possible in a simple manner the enlargement of a starting volume or an air smoothing chamber. In the embodiment illustrated in the drawings, a still larger-volume is provided by a pressure chamber 63 formed in an edge of the crankcase housing between the two faces on which the cylinder blocks are mounted. This pressure chamber 63 is in communication with the pressure air bore 62 through an air channel 64 formed in the crankcase 11 and a block air channel 65 formed in the cylinder block 12. From the pressure chamber 63 the compressed air can be taken through a connecting bore 66. A check valve is screwed into the connecting bore 66 but is not shown in the drawings.

The pressure chamber 63 is formed as a blind bore in an edge portion of the crankcase 11 and extends in a direction parallel to the axis of rotation of the crankshaft. It is closed through a screwed-in closure 67 and sealed by an O-ring. The air channel 64 in the crankcase opens on the supporting face 68 on which the cylinder block 12 is mounted. The air channel opening is surrounded by a groove 70 in which an O-ring 71 is set. The cylinder block 12 is mounted on the crankcase with its plane face 72 engaging the supporting face 68 of the crankcase so that the block air channel opening 73 from the block air channel 65 mates with the air channel 64 of the crankcase. A seal is provided by the O-ring. In this manner a tight connection between the pressure air bore 62 of the cylinder block 12 and the pressure chamber 63 in the crankcase is achieved.

If, as illustrated in FIG. 1, the crankcase is provided for mounting two cylinder blocks 12, the pressure chamber 63 has two air channels 64 but only one connecting bore 66. A crankcase 11 with such a pressure chamber 63 can easily be produced as a cast part if, as illustrated, the openings 27 for the pistons open to the front side of the crankcase so that the mold can be easily opened. After the casting, very little machining is required. The opening of the dead end pressure chamber 63 is threaded for screwing in the closure 67. Around the air channel openings 69, grooves 70 are formed to receive the O-rings 71 and tapped holes 33 are provided for the bolts for securing the cylinder blocks and cylinder heads on the crankcase. No special production of the pressure air connecting channels is required since the pressure chamber 63 and pressure air conducting channels are the same whether one or two cylinder blocks are used. If only one cylinder block 12 is used the second air channel 64 is merely closed.

Also the cylinder block 12 with cooling air passages, suction air bore and pressure air bore all extending axially of the cylinder block is simple to produce as a cast part. After casting, it is only necessary to mill the block air channel opening 73 so that the O-ring 71 between the crankcase opening 69 and the block air channel opening 73 makes a good seal. Around the pressure air bore opening 74 and the compression cylinder bore opening 75 grooves 70 are milled to receive O-rings 71. These seat against the lower steel plate 49 of the reed valve plate 13. The simple production of the cylinder head 14 with no working after casting except for inserting the closure cap 55 has already been described.

It will thus be seen that with the compressor construction in accordance with the invention there is provided a compressor which can be produced in a simple manner from aluminum cast parts which require very little working after casting. Through the special path of the pressure air stream 57 there is scarcely any sealing problem so that it is sufficient to secure the cylinder head 14, reed valve plate 13 and cylinder block 12 to the crankcase 11 with three bolts 32. The integration of the air filter 40 in the cylinder block 12 and the cylinder head 14 as well as the integration of starting and air smoothing volumes in the cylinder block 12 and the crankcase 11 assures an especially trouble-free and quiet running of the compressor. Through the cooling air passages in the cylinder block and cylinder head extending in the direction of the longitudinal axis of the cylinder block a particularly effective cooling and thereby a high output and long life of the compressor are obtained.

From the approximately square form of the crankcase 11 of the illustrated embodiment it follows that the two support faces 68 on which the cylinder blocks 12 are mounted are at right angles to one another. Such an arrangement assures as a rule an especially effective correction of unbalance in the crank assembly for driving the two pistons 20. Frequently, however, with such a drive an angle of 120° between the two cylinder-supporting surfaces is selected. With other reciprocating compressing members, other angles between the supporting faces of the crankcase can be selected.

With the illustrated embodiment of the invention having two cylinder blocks, the pressure chamber 63 is common to both compression cylinders 62 so that no pressure conduits are necessary and the compressed air from both cylinders can be taken from the single connecting bore 66. In this way an especially large starting and air quieting volume for the compressed air is provided. If, however, a large suction volume is desired to reduce suction noise, the two suction bores 39.12 in the two cylinder blocks 12 can be closed at their upper ends and connected with a common chamber in the edge portion of the crankcase 11. However, in this case a separate compressed air take-off is required for each cylinder head 14.

Instead of the fan 17 for drawing cooling air into the crankcase 11, it is possible to provide the motor 22 at its rear end with a strong blower which blows cooling air first over the motor winding and then into the crankcase 11 through the motor shaft opening 23 and from here through the piston openings 27 and, as described above, through the cooling air passages of the cylinder block and cylinder head.

Instead of the described reed valve plate 13, another valve arrangement between the cylinder block 12 and the cylinder head 14 can be used. Essential for the invention is that air stream passages for the cooling air and working air extend in the direction of the cylinder block axis whereby an especially effective cooling is attained and a simple easily produced construction is achieved which leads to many advantages.

According to the requirements of compressed air volume, an oil free compressor in accordance with the invention can be built in a variety of sizes. For example a compressor having two cylinders with a cylinder diameter of 47 mm and piston stroke of 40 mm running at a speed of about 1400 RPM delivers approximately 100 liters of air per minute at a pressure of 7 bar. FIGS. 4 to 8 are full scale drawings of the cylinder block and cylinder head of such a compressor. The combined starting and quieting air volume of the pressure air bore 62 and the pressure chamber 63 is about 130 ccm.

While a preferred embodiment of the invention is illustrated in the drawings and herein particularly described, it will be understood that modifications and variations are possible and that the invention is thus in no way limited to the illustrated embodiment.

What we claim is:

1. A compressor comprising a crankcase, a motor driven crankshaft rotatable in said crankcase, a cylinder block mounted on said crankcase with a cylinder bore perpendicular to the axis of rotation of said crankshaft, a cylinder head mounted on an outer end of said cylinder block to close the outer end of said cylinder bore, through bolts securing said cylinder block to said crankcase and securing said cylinder head to said cylinder block, inlet and outlet valve means associated with said cylinder head and a piston reciprocable in said cylinder bore by said crankshaft, said cylinder block and cylinder head having around their periphery means defining an array of aligned cooling air passages extending axially of said cylinder block and cylinder head, said cooling air passages comprising outwardly open spaces between peripherally spaced cooling fins that extend axially of said cylinder block and cylinder head and further comprising aligned, peripherally spaced, axially extending tubular openings through which said through bolts extend and are screwed into tapped holes in said crankcase to secure said cylinder head and cylinder block to said crankcase, said crankcase having cooling air inlet means, air blower means in said crankcase and driven by said crankshaft for drawing cooling air through said cooling inlet means into said crankcase, said crankcase further having an opening over which said cylinder block is mounted, said opening being of a size and shape to open not only into said cylinder bore but also into said axially extending cooling air passages of said cylinder block, whereby cooling air drawn into said crankcase by said blower means flows from said crankcase into and through said axially extending cooling air passages of said cylinder block and cylinder head to cool said cylinder block and cylinder head.

2. A compressor comprising a crankcase, a crankshaft rotatable in said crankcase, a motor at one end of the crankcase connected to said crankshaft for driving said crankcase, an inlet air opening in an opposite end of said crankcase, a fan on said crankshaft inwardly of said air inlet opening to draw air through said inlet opening into the crankcase, said crankcase having an opening intermediate its ends for the mounting of a cylinder block, a cylinder block mounted on said crankcase over said intermediate opening of said crankcase, a piston reciprocable in said cylinder bore by said crankshaft, a cylinder head closing an outer end of said cylinder block, inlet and outlet valve means associated with said cylinder head, said cylinder block and cylinder head being generally square in cross section and having around their periphery an array of axially extending passages comprising axially extending bores in corner portions of the cylinder block and spaces between axially extending fins on sides of said cylinder block between corners, said passages comprising passages through which through bolts extend to secure said cylinder head and cylinder block to said crankcase and air cooling passages communicating at their inner ends through said intermediate opening with the interior of said crankcase to receive from said crankcase air drawn into said crankcase by said fan.

3. A compressor comprising a crankcase, a crankshaft rotatable in said crankcase, a motor at one end of the crankcase connected to said crankshaft for driving said crankshaft, inlet air openings in an opposite end of said crankcase, a fan on said crankshaft inwardly of said air inlet openings to draw air through said inlet openings into crankcase, said crankcase having an opening intermediate its ends for the mounting of a cylinder block, a cylinder block mounted on said crankcase over said intermediate opening with a cylinder bore opening into said intermediate opening of said crankcase, a piston reciprocable in said cylinder bore by said crankshaft, a cylinder head closing an outer end of said cylinder block, inlet and outlet valve means associated with said cylinder head, said cylinder block being generally square in cross section and formed with a plurality of axially extending cooling air passages surrounding said cylinder bore, said axially extending cooling air passages comprising axially extending bores in corner portions of said cylinder block and spaces between axially extending fins on sides of said cylinder block between corners thereof, and said cylinder head being formed with cooling air passages aligned with the axially extending cooling air passages of said cylinder block, through bolts extending through at least three of said axially extending cooling air passages of said cylinder block and cylinder head, spaced circumferentially from one another and screwed into tapped holes in said crankcase to secure said cylinder head and cylinder block to said crankcase, said axially extending cooling air passages communicating at their inner ends through said intermediate opening with the interior of said crankcase to receive from said crankcase air drawn into said crankcase by said fan.

4. A compressor according to claim 3, in which said axially extending bores in two corners are cooling air passages, an axially extending bore in a third corner of said cylinder block is for inlet of air to be compressed and an axially extending bore in a fourth corner of said cylinder block is for discharge of compressed air.

5. A compressor according to claim 3, in which said passages through which said through bolts extend are axially extending bores in two corners of said cylinder block and a third passage on a side of said block opposite said two corners.

6. A compressor comprising a crankcase, a motor driven crankshaft rotatable in said crankcase, a cylinder block mounted on said crankcase with a cylinder bore perpendicular to the axis of rotation of said crank shaft, a cylinder head mounted on an outer end of said cylinder block to close the outer end of said cylinder bore, inlet and outlet valve means associated with said cylinder head and a piston reciprocable in said cylinder bore by said crankshaft, said cylinder block having around its periphery means integral with said cylinder block defining an array of cooling air passages extending axially of said cylinder block, said crankcase having cooling air inlet means, air blower means in said crankcase and driven by said crankshaft for drawing cooling air through said cooling air inlet means into said crankcase, said crankcase further having an opening over which said cylinder block is mounted, said opening being of a size and shape to open not only into said cylinder bore but also into said axially extending cooling air passages of said cylinder block, whereby cooling air drawn into said crankcase by said blower means flows from said crankcase into and through said axially extending cooling air passages of said cylinder block to cool said cylinder block, said cylinder head and cylinder block having therein a suction bore which extends axially of said cylinder block, has an air inlet at its outer end and communicates through connecting means and said inlet valve means with said cylinder bore.

7. A compressor according to claim 6, in which an air filter in said suction bore is removable therefrom in a direction axial of said cylinder block for replacement.

8. A compressor according to calim 6, in which said inlet valve means comprises a two-layer read valve plate between said cylinder head and cylinder block and reed valves mounted thereon, said reed valve plate comprising a lower steel plate and an upper plate of packing material, an inlet reed valve being mounted on the upper face of the upper layer and an outlet reed valve being mounted on the upper face of the lower layer.

9. A compressor according to claim 8, in which said connecting means comprises a recess formed in an inner face of said cylinder head facing said reed valve plate.

10. A compressor comprising a crankcase, a motor-driven crankshaft rotatable in said crankcase, at least one cylinder block mounted on said crankcase with a cylinder bore perpendicular to the axis of rotation of said crankshaft, a cylinder head closing an outer end of said cylinder block, inlet and outlet valve means associated with said cylinder head, and a piston reciprocable in said cylinder bore by said crankshaft, said cylinder block having around its perimeter an array of cooling air passages extending axially of said cylinder block, a suction bore integral in said cylinder block extending axially of said cylinder block and communicating through connecting means and said inlet valve means with said cylinder bore, a compressed air bore integral in said cylinder block extending axially of said cylinder block and communicating through connecting means and said outlet valve means with said cylinder bore, said cylinder block being generally square in a cross section perpendicular to the axis of said cylinder bore, and said suction bore being integral in one corner portion of said cylinder block, said compressed air bore being integral in another corner portion of said cylinder block and said cooling air passages comprising cooling air bores in the other two corner portions of said cylinder block.

11. A compressor according to claim 10, in which said suction bore and compressed air bore are in adjacent corner portions of said cylinder block, and in which bolts connecting said cylinder head and cylinder block with said crankcase comprise two bolts which extend respectively through said cooling air bores and a third bolt which extends through a bore in a side portion of said cylinder block between said suction bore and said compressed air bore.

12. A compressor according to claim 10, in which said cooling air passages further comprise spaces between peripherally spaced axially extending cooling fins on all four sides of said cylinder block.

13. A compressor according to claim 12, in which said cylinder head has cooling air passages which extend in a direction axial of said cylinder block and which form continuations of said cooling air passages in said cylinder block.

14. A compressor according to claim 13, in which said crankcase has cooling air inlet means and means for moving cooling air through said inlet means into said crankcase, and in which said cooling air passages of said cylinder block are in communication at their inner ends with the interior of said crankcase, whereby cooling air flows through said inlet means into said crankcase and from said crankcase into and through said cooling air passages of said cylinder block.

15. A compressor comprising a crankcase, a motor driven crankshaft rotatable in said crankcase, a cylinder block mounted on said crankcase with a cylinder bore perpendicular to the axis of rotation of said crankshaft, a cylinder head mounted on an outer end of said cylinder block to close the outer end of said cylinder bore, inlet and outlet valve means associated with said cylinder head and a piston reciprocable in said cylinder bore by said crankshaft, said cylinder block having around its periphery means integral with said cylinder block defining an array of cooling air passage extending axially of said cylinder block, said crankcase having cooling air inlet means, air blower means in said crankcase and driven by said crankshaft for drawing cooling air through said cooling air inlet means into said crankcase, said crankcase further having an opening over which said cylinder block is mounted, said opening being of a size and shape to open not only into said cylinder bore but also into said axially extending cooling air passages of said cylinder block, whereby cooling air drawn into said crankcase by said blower means flows from said crankcase into and through said axially extending cooling air passages of said cylinder block to cool said cylinder block said cylinder block having a compressed air bore integral in said cylinder block which extends axially of said cylinder block and communicates through connecting means and said outlet valve means with said cylinder bore, and said crankcase having a compressed air chamber formed integrally inside said crankshaft and communicating with said compressed air bore of said cylinder block.

16. A compressor according to claim 15, in which said compressed air chamber is inside a side portion of said crankcase adjacent to said cylinder block and extends parallel to the axis of rotation of said crankshaft.

17. A compressor according to claim 16, in which two like cylinder blocks are mounted on said crankcase at an angle of 90° to one another, and in which said compressed air chamber is disposed between said cylinder blocks and communicates with said compressed air bores of both of said cylinder blocks.

* * * * *